United States Patent [19]

Altenpohl et al.

[11] 4,270,336

[45] Jun. 2, 1981

[54] DISTRIBUTED PLURAL STATION BAGGING SYSTEM FOR POULTRY

[75] Inventors: William F. Altenpohl; Paul J. Altenpohl, both of High Point, N.C.

[73] Assignee: W. F. Altenpohl, Inc., High Point, N.C.

[21] Appl. No.: 10,595

[22] Filed: Feb. 8, 1979

Related U.S. Application Data

[63] Continuation-in-part of Ser. No. 956,994, Oct. 31, 1978, Pat. No. 4,221,106, which is a continuation-in-part of Ser. No. 845,231, Oct. 25, 1977.

[51] Int. Cl.[3] ..... B65B 5/00

[52] U.S. Cl. ..... 53/493; 198/358

[58] Field of Search ..... 198/358, 341; 209/593-595; 53/502, 493

[56] References Cited

U.S. PATENT DOCUMENTS

| | | | |
|---|---|---|---|
| 3,006,452 | 10/1961 | Hill | 198/358 |
| 3,773,163 | 11/1973 | Ruddick | 198/358 |
| 3,986,597 | 10/1976 | Valentino | 198/358 |

*Primary Examiner*—Robert B. Reeves
*Assistant Examiner*—Douglas D. Watts
*Attorney, Agent, or Firm*—Harvey B. Jacobson

[57] ABSTRACT

Poultry releasably suspended from a conveyor is distributed amongst a plurality of stations along a travel path of the conveyor from which the poultry is released. Release under control of sensors from the conveyor is effected only at those stations at which product bagging apparatus are inactive. Lock-out devices at each station prevent release while the bagging apparatus is in operation for a period of predetermined duration.

6 Claims, 5 Drawing Figures

13
2
10
2
12

LATCH RELEASE DEVICE
80
84
20
86
82
84
74
88
86
66
96
98
70
92
90
74
78

DISTRIBUTED PLURAL STATION BAGGING SYSTEM FOR POULTRY

This application is a continuation-in-part of Ser. No. 956,994, Oct. 31, 1978 now U.S. Pat. No. 4,221,106, which is a continuation-in-part of Ser. No. 845,231, Oct. 25, 1977 pending.

BACKGROUND OF THE INVENTION

This invention relates in general to the processing and handling of products such as poultry and is related by common subject matter to our prior copending applications, Ser. No. 845,231, filed Oct. 25, 1977, Ser. No. 956,994, filed Oct. 31, 1978, and Ser. No. 6,238 filed Jan. 24, 1979.

According to our aforesaid prior copending applications, products in the form of fresh poultry are conveyed along a path of travel and are dropped at a bagging station for automatic loading into flexible film bags. The automatic bag loading operation at the bagging station has an operational cycle of predetermined duration that limits the rate at which products are capable of being bagged for a single conveyor line. To increase the rate of bagging, a plurality of bagging stations may be used. However, separate and parallel operating conveyor lines are ordinarily required for the respective bagging stations. The cost of separate conveyors may not however be warranted if, production rate demands are variable resulting in conveyors being idle when production demand is low.

The use of a single conveyor line servicing a plurality stations with means to distribute the drop off of poultry amongst the different stations, is disclosed in our prior U.S. Pat. No. 3,944,078. Distribution according to this patent is controlled by counters to equalize the use of the various stations rather than meet any varying production rate demands.

It is therefore an important object of the present invention to provide a single conveyor line capable of servicing a plurality of stations at which time consuming operations are performed, such as automatic bagging, in accordance with varying production rate demands.

SUMMARY OF THE INVENTION

In accordance with the present invention, a single overhead conveyor establishes a common path of travel for suspended poultry extending through a plurality of stations at which automatic bagging operations are performed in response to the drop off of poultry. During operation of the automatic apparatus, such as the bagging apparatus disclosed in our copending applications aforementioned, an activity sensing lock-out device is activated to prevent release or drop-off of any poultry enabling the conveyor to convey the poultry to the next station. Drop-off of poultry is permitted by lock-out devices only at stations at which the automatic bagging apparatus is inactive. The rate of travel of the conveyor may therefore be increased for bagging of poultry at a higher rate than that possible at a single bagging station. Further, the number of bagging stations activated will depend on the rate of travel to which the conveyor is set.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
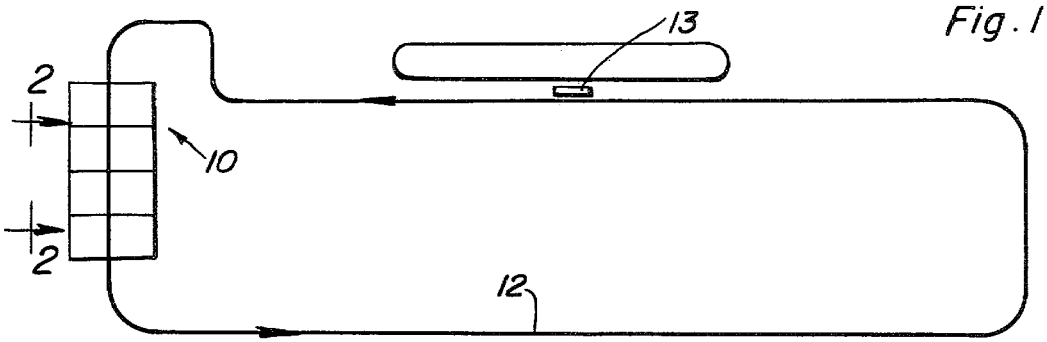
FIG. 1 is a schematic top plan view of a typical installation for the present invention.
Figure 2:
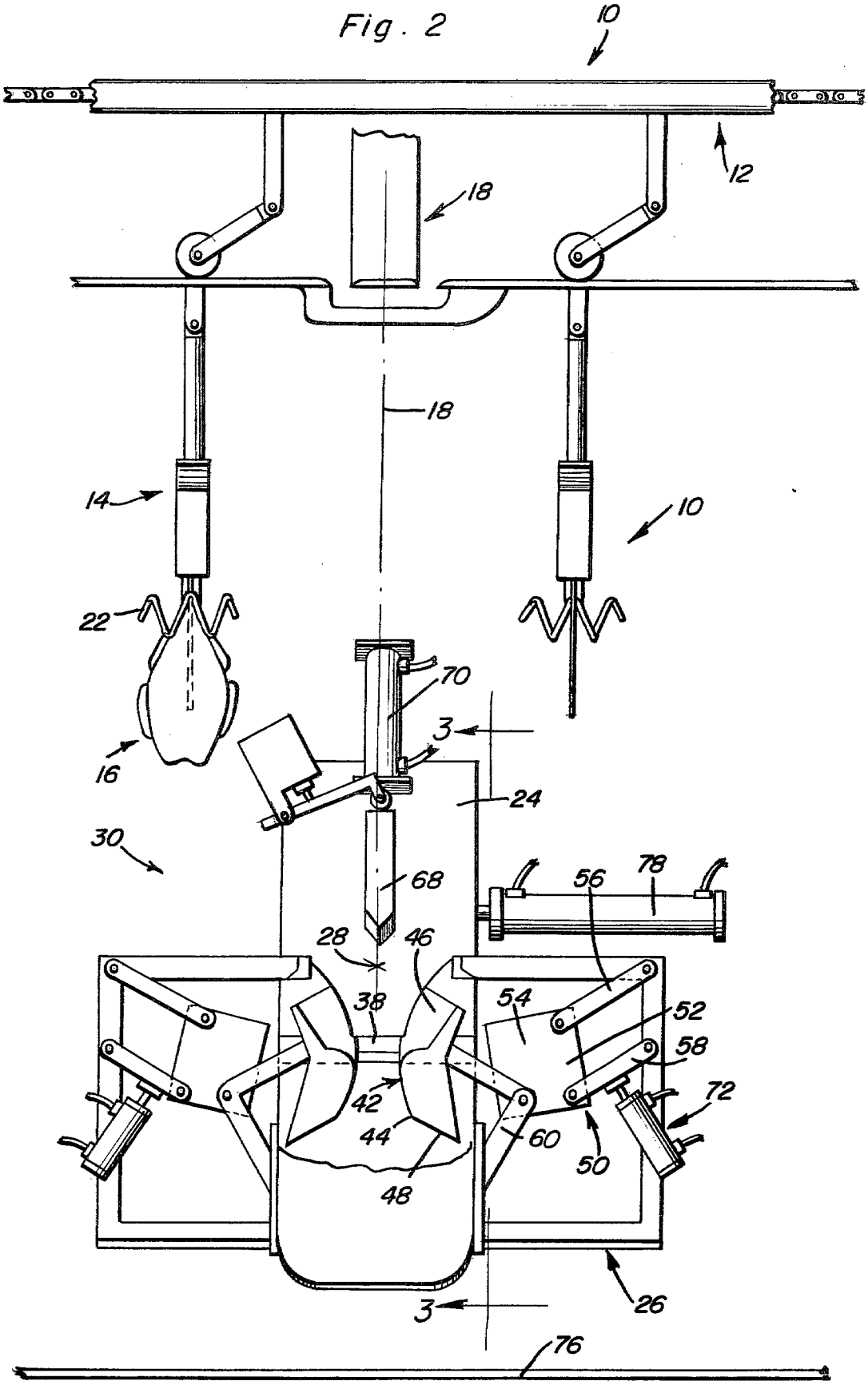
FIG. 2 is a front elevational view showing the typical processing station associated with the present invention.
Figure 3:
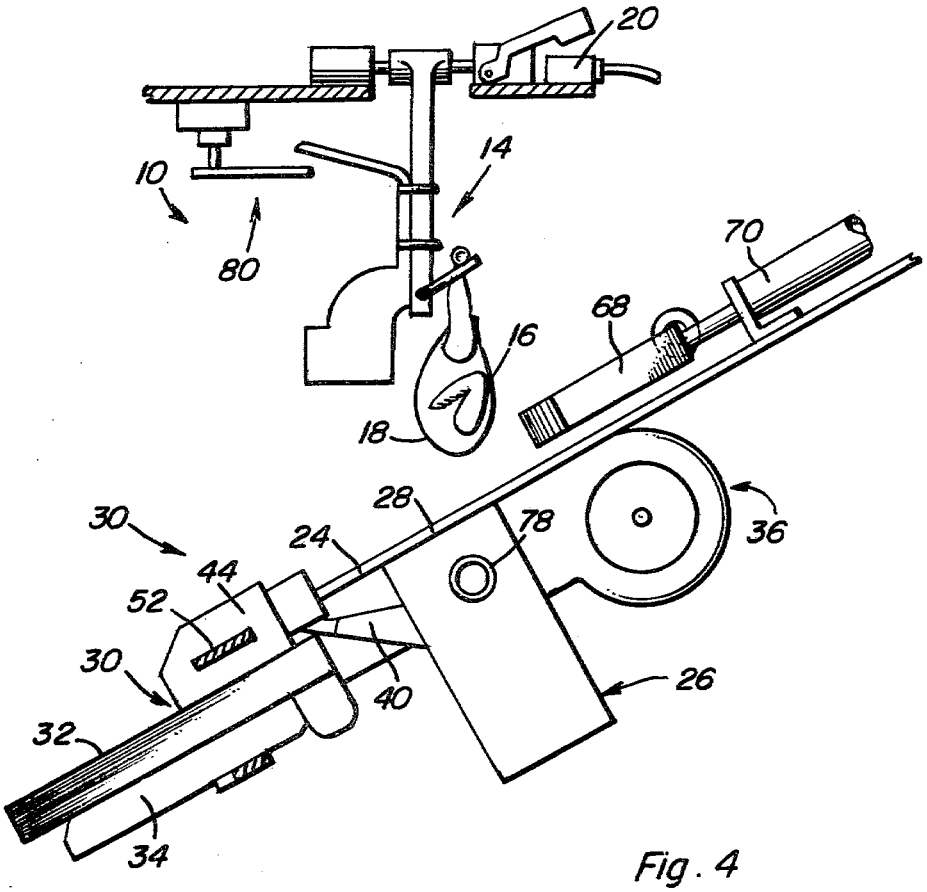
FIG. 3 is a partial side sectional view taken substantially through a plane indicated by section line 3—3 on FIG. 2.

Referring now to the drawings and detail, FIG. 1 illustrates an installation including a plurality of stations 10 suitably located along the path of travel of an overhead conveyor 12 adapted to be loaded by personnel at a loading station 13 in a poultry processing plant, for example. By means of the overhead conveyor 12, poultry carriers generally referred to by reference numeral 14 in FIG. 2 convey birds 16 to a sensor 18 of a well known type at which a load is detected. In a manner well known in the art, dropping of a bird at the station 10 is controlled by a signal generator 20 as shown in FIG. 3 from which a release signal originates. This signal initiates an automatic cycle in a bagging apparatus 30 shown in FIGS. 2 and 3 and disclosed and claimed in our prior copending applications aforementioned.

Figure 4:
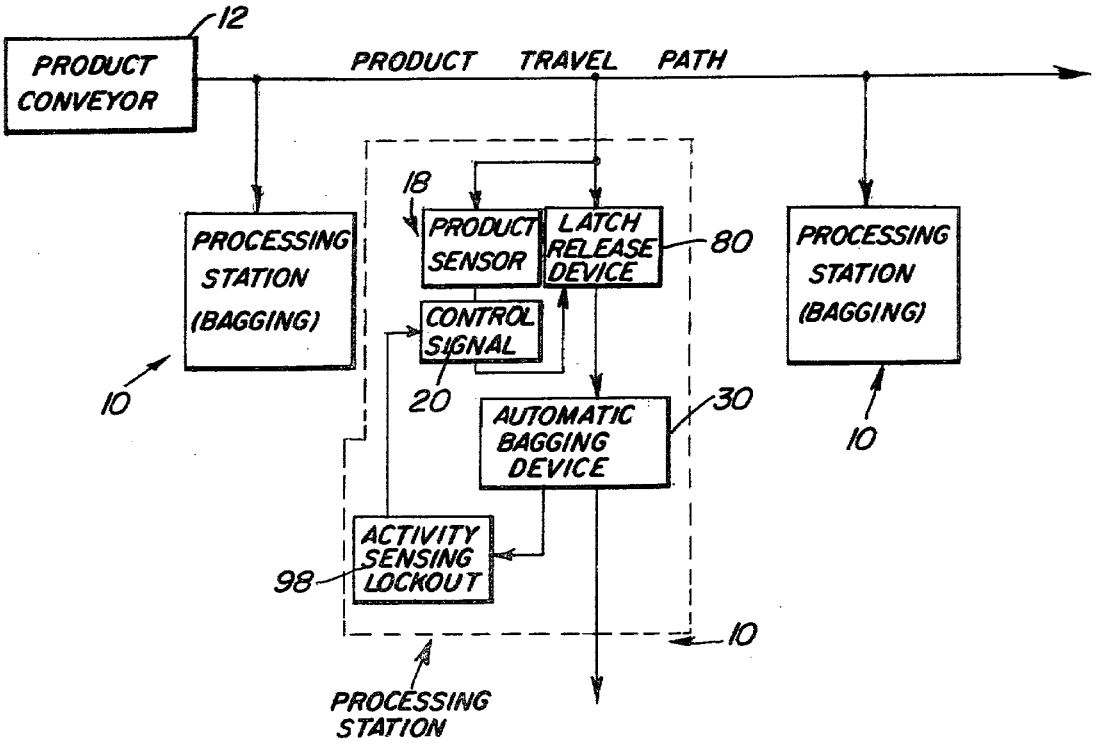
FIG. 4 is a schematic block diagram illustrating the control system associated with the present invention.

FIG. 4 diagrammatically illustrates the control system of the present invention depicting movement of a product in the form of poultry by the conveyor 12 to the stations 10 at which it is automatically released by a release mechanism 80 as shown in FIG. 3 so that the product may drop into the automatic bagging apparatus 30. Operation of the bagging device is triggered by a release signal from signal generator 20 as aforementioned which also operates the release mechanism 80.

Figure 5:
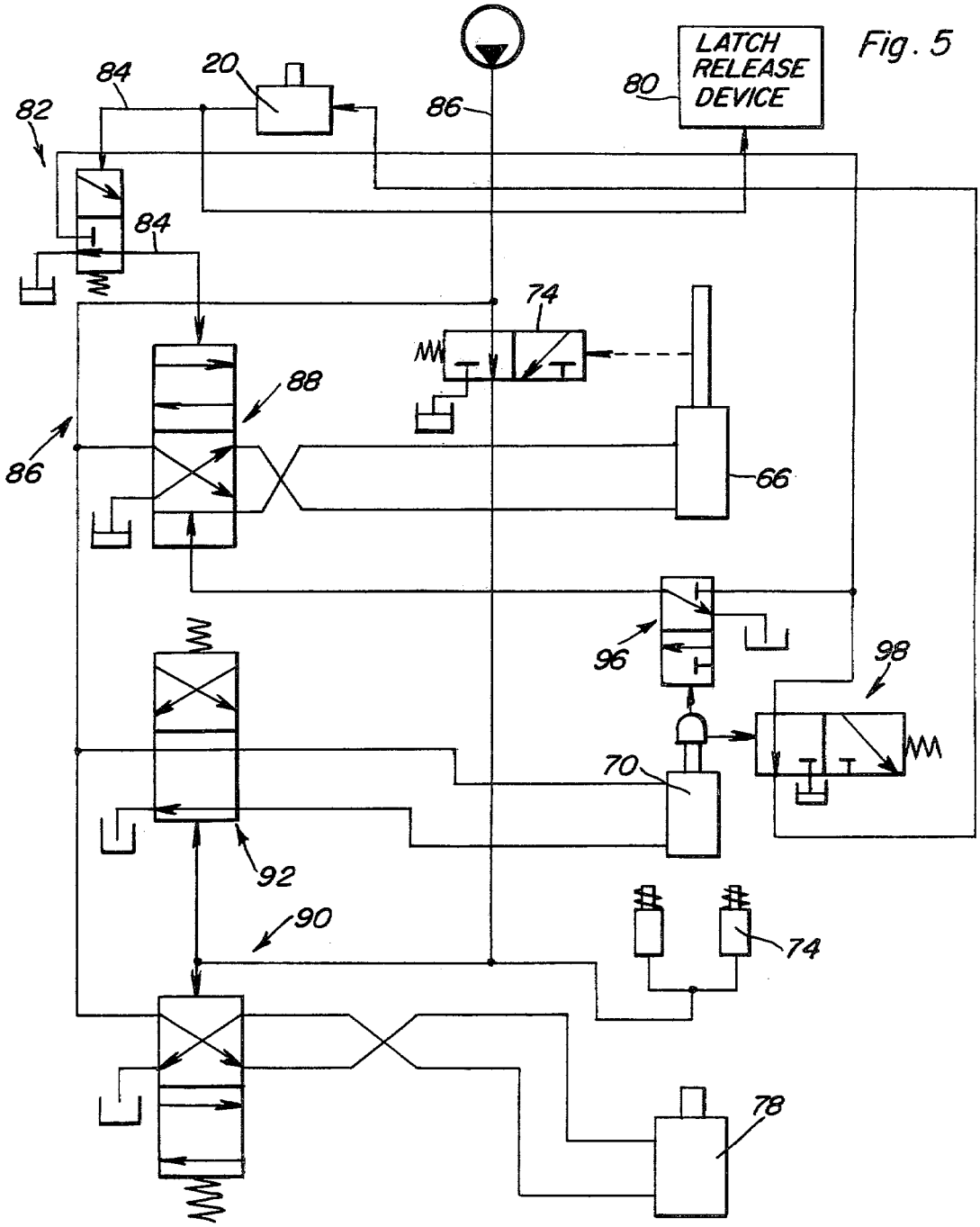
FIG. 5 is a simplified fluid circuit diagram corresponding to the control system illustrated in FIG. 4.

A simplified automatic control circuit 82 is shown in FIG. 5. The fluid operating medium utilized for the various controls aforementioned may be in the form of pressurized air from a suitable source through line 86 connected to signal operated control valves 88, 90 and 92.

In response to a release signal in line 84 from generator 20, an automatic bagging cycle is initiated as disclosed in our prior copending applications aforementioned. When the packing ram 68 of the apparatus 30 completes its operational stroke, a limit control 96 is actuated in order to apply a valve reversing signal to the control valves 88, 90 and 92 causing reversal of the controls 66, 74, 78 and 70. All of such controls are simultaneously retracted to complete an operational cycle as the limit switch 96 opens restoring the system to its initial condition.

When an operational cycle is begun, a lock-out valve control 98 normally held in the position shown in FIG. 5 by the ram 68 in its inactive position, is displaced under a spring bias to cut off pressurized fluid to signal generator 20. The signal generator is thereby disabled so that it cannot operate the release mechanism 80. Only at the end of the operational cycle is the valve control 98 restored to its initial position reflecting the inactive state of the bagging apparatus and enabling the signal generator 20. Thus, during operation of the bagging device 30, poultry loaded carriers may be conveyed past the bagging station to the next station and released thereat only if its bagging device is inactive.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a conveyor establishing a common path of travel through a plurality of stations at which continuously moving products suspended from the conveyor are released in response to detection by a sensor at each of the stations and means at each of the stations for bagging the released products during an operational cycle of predetermined duration activated by the sensor, each of said bagging means having an element movable during the operational cycle activated by the sensor, a system for distributing the products for release amongst said stations to effect said bagging at a maximum rate, including an activity sensing lock-out device located at each of said stations engageable with the movable element for preventing operation of the sensor associated with a station at which the operational cycle of the bagging means is activated, whereby a product is conveyed along the path of travel of the conveyor to a following station at which the bagging means is inactive, said movable element being a product packing ram displaceable from a retracted position engaging the lock-out device to an extended position during said operational cycle.

2. In combination with a conveyor establishing a common path of travel through a plurality of stations at which continuously moving products suspended from the conveyor are released in response to detection by a sensor at each of the stations and means at each of the stations for bagging the released products during an operational cycle of predetermined duration activated by the sensor, a system for distributing the products for release amongst said stations to effect said bagging at a maximum rate, including an activity sensing lock-out device located at each of said stations for preventing operation of the sensor associated therewith during the operational cycle of an activated bagging means, whereby a product is conveyed along the path of travel of the conveyor to a following station at which the bagging means is inactive, said bagging means including a product packing ram displaceable from a retracted position engaging the lock-out device to an extended position during said operational cycle.

3. The combination of claim 1 wherein said activity sensing lock-out device is engageable by the movable element of the bagging means in an inactive state for enabling the sensor.

4. The combination of claim 2 wherein said sensor includes means for detecting a product at the station and means responsive to said detection of the product for dropping the product from the conveyor into the bagging means.

5. The combination of claim 4 wherein said objects are poultry.

6. The combination of claim 1 wherein said sensor includes means for detecting a product at the station and means responsive to said detection of the product for dropping the product from the conveyor into the bagging means.

* * * * *